United States Patent [19]

Jahnke et al.

[11] Patent Number: 4,462,339

[45] Date of Patent: Jul. 31, 1984

[54] GAS COOLER FOR PRODUCTION OF SATURATED OR SUPERHEATED STEAM, OR BOTH

[75] Inventors: Frederick C. Jahnke, Rye; James R. Muenger, Beacon, both of N.Y.

[73] Assignee: Texaco Development Corporation, White Plains, N.Y.

[21] Appl. No.: 527,452

[22] Filed: Aug. 29, 1983

[51] Int. Cl.[3] ..... F22D 1/00

[52] U.S. Cl. ..... 122/7 R; 122/32; 122/504.2; 165/163

[58] Field of Search ..... 165/157, 163; 122/32, 122/7 R, 504.2

[56] References Cited

U.S. PATENT DOCUMENTS

| | | | |
|---|---|---|---|
| 3,610,207 | 10/1971 | Ruhe | 122/7 R |
| 3,690,374 | 9/1972 | Volhardt | 122/32 X |
| 3,915,224 | 10/1975 | Richter et al. | 122/32 X |
| 4,307,685 | 12/1981 | Robin | 122/32 |

FOREIGN PATENT DOCUMENTS

| | | | |
|---|---|---|---|
| 1124512 | 3/1962 | Fed. Rep. of Germany | 122/7 R |

*Primary Examiner*—Edward G. Favors

*Attorney, Agent, or Firm*—Robert A. Kulasen; Albert Brent

[57] ABSTRACT

A gas cooler and process are provided for extracting heat from the hot raw gas stream from the partial oxidation of a hydrocarbonaceous or carbonaceous fuel, and the simultaneous production of a separate stream of saturated or superheated steam, or separate streams of both. The gas cooler comprises a vertical pressure vessel with an upper central outlet through which saturated steam may be removed and a closed bottom. A refractory lined hot gas inlet chamber is attached to the bottom of the pressure vessel. A coaxial vertical watertight cylindrically shaped central chamber is supported within the vessel and defines an annular elongated passage with the inside walls of the vessel. A plurality of bundles of helical tubes through which the hot gas flows are spaced in the annular passage and are serially connected to a helical bundle of gas tubes that is supported in the central chamber. Concurrent indirect heat exchange between boiler feed water and the hot gas takes place in the annular passage or evaporative section to produce saturated steam. Countercurrent indirect heat exchange between saturated steam and partially cooled gas takes place in the central chamber to produce superheated steam. Advantageously, the gas cooler may be easily turned up or down with load by closing off one or more of the helical tubes. Further, along with the efficient cooling of a hot gas stream containing entrained matter, saturated or superheated steam, or both may be simultaneously produced in the same vessel.

27 Claims, 1 Drawing Figure

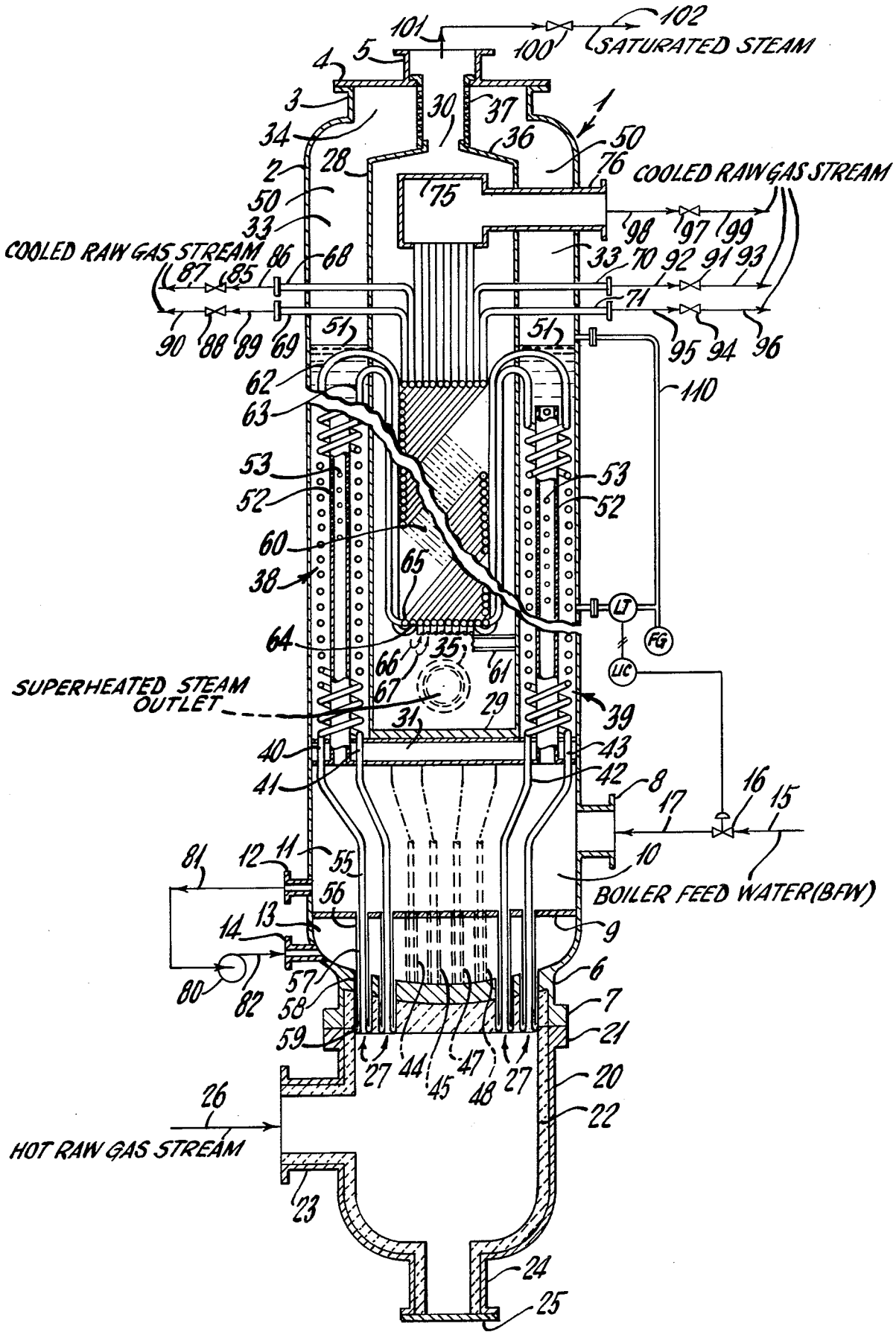
SATURATED STEAM
COOLED RAW GAS STREAM
COOLED RAW GAS STREAM
SUPERHEATED STEAM OUTLET
BOILER FEED WATER(BFW)
HOT RAW GAS STREAM
LT
FG
LIC

GAS COOLER FOR PRODUCTION OF SATURATED OR SUPERHEATED STEAM, OR BOTH

BACKGROUND OF THE INVENTION

This invention relates to a gas cooler and process for cooling a hot raw gas stream and for simultaneously producing saturated and/or superheated steam. More particularly, it relates to a gas cooler and process for extracting heat from the hot raw gas stream from the partial oxidation process, and the simultaneous production of a separate stream of saturated or superheated steam, or separate streams of both.

Synthesis gas, reducing gas and fuel gas are commonly produced by the partial oxidation of gaseous and liquid hydrocarbonaceous fuel, and from solid carbonaceous fuel. For example, reference is made to the partial oxidation processes described in coassigned U.S. Pat. No. 3,620,699; 3,639,261; and 3,998,609.

The raw effluent gas stream comprising $H_2$, CO and entrained particulate matter leaves the reaction zone of the partial oxidation gas generator at a temperature in the range of about 1700°–3000° F. and a pressure in the range of about 1 to 250 atmospheres. The raw gas stream may be cooled to a temperature in the range of about 600° F. to 1200° F. by indirect heat exchange with water in a gas cooler or waste heat boiler. By-product saturated steam may be thereby produced. The saturated steam is often superheated in outside equipment, such as a fired heater. In coassigned U.S. Pat. No. 4,099,382, saturated steam that is produced in a downstream heat exchanger is recycled and superheated in another heat exchanger that is located upstream from the downstream heat exchanger. In coassigned U.S. Pat. No. 4,247,302, saturated steam is produced in one or more shell-and-straight fire tube gas coolers and then superheated in another shell-and-straight fire tube gas cooler. A waste heat boiler with helical cooling tubes whose ends are in communication with water cooled gas inlet pipes is described in U.S. Pat. No. 4,029,054. Cooling the inlet ends of gas tubes by means of a coolant is described in U.S. Pat. No. 3,610,329.

SUMMARY OF THE INVENTION

In accordance with the invention, a gas cooler and process are provided for cooling a hot raw gas stream, such as the hot raw effluent gas stream from the partial oxidation of a gaseous or liquid hydrocarbonaceous fuel or a solid carbonaceous fuel, and recovering the sensible heat in the gas stream. The hot gas stream is cooled by being passed in indirect heat exchange with water. Simultaneously, there may be produced a separate stream of saturated or superheated steam, or separate streams of both. The saturated and superheated steam are simultaneously produced in the same vessel.

The gas cooler comprises a closed vertical cylindrically shaped pressure vessel with an upper central outlet for the discharge of saturated steam. A vertical coaxial cylindrically shaped elongated central chamber with a closed bottom and an open top is supported within the vessel above the bottom end. A water chamber connected to a source of boiler feed water extends between the lower ends of the central chamber and the pressure vessel. This chamber communicates with an overhead annular passage formed between the inside wall of the pressure vessel and the outside wall of the central chamber. A connecting passage at the upper end of the pressure vessel provides communication between the upper ends of the annular passage, central chamber, and the upper central outlet of the pressure vessel. Optionally, a demister may be inserted in this communicating passage. A refractory lined hot gas inlet chamber is attached to the lower end of the pressure vessel. A plurality of vertical bundles of helical tubes extend lengthwise in said annular passage; and, at least one vertical bundle of helical tubes extends lengthwise in the central chamber. The outlets of the helical tubes in the annular passage are joined to the inlets of the helical tubes in the central chamber. The inlet ends of the helical tubes in the annular passage extend into the refractory lined hot gas inlet chamber and are water jacketed. The outlet ends of the helical tubes through which the cooled gas leaves the central chamber may penetrate the wall of the pressure vessel or a flange cover for the central outlet of the pressure vessel. Alternative designs use internal headers.

In operation of the gas cooler, water in the annular passage circulates concurrently with the hot gas flowing in the helical tubes and is evaporated to produce saturated steam. By means of control valves in the external lines, all of the saturated steam produced in the annular passage may be removed through the upper central outlet. Alternatively, all of the saturated steam may be superheated by being passed over the helical tubes in the central chamber in indirect countercurrent heat exchange with the partially cooled gas stream flowing within the helical tubes. The superheated steam is discharged through a conduit at the bottom of the central chamber that passes through the wall of the pressure vessel. In another embodiment, both saturated and superheated steam are simultaneously produced. When the amount and temperature of the hot raw gas stream that is introduced into the gas cooler are fixed, the temperatures of the saturated steam, superheated steam, and cooled raw gas leaving the gas cooler are controlled by varying the water level in the annular passage, and by controlling the split between the saturated and superheated steam.

BRIEF DESCRIPTION OF THE DRAWING

The FIGURE is a front elevational view, in section, of the gas cooler comprising the present invention.

DESCRIPTION OF THE INVENTION

A more complete understanding of the invention may be had by reference to the accompanying schematic drawing which shows the subject invention in detail. Although the drawing illustrates a preferred embodiment of the invention, it is not intended to limit the subject invention to the particular apparatus or materials described. The drawing depicts an apparatus for cooling a stream of raw gas, e.g., synthesis gas, reducing gas or fuel gas from the partial oxidation process and simultaneously producing a separate stream of saturated or superheated steam, or separate streams of both. The hot raw gas stream comprises a mixture of $H_2O$, CO, $CO_2$ and at least one material selected from the group consisting of $H_2O$, $N_2$, A, $CH_4$, $H_2S$ and COS. Particulate matter, e.g., unconverted carbon, soot, and ash may be also entrained in the raw gas stream. The raw gas stream enters the gas cooler at a temperature in the range of about 1700° to 3000° F., such as about 2200° to 2800° F. and a pressure in the range of about 10 to 200 atmospheres (atms.) such as 35 to 100 atms. The raw gas stream leaves the gas cooler after being cooled by indirect heat exchange first with boiler feed water and then with saturated steam at a temperature in the range of about 400° to 800° F. The pressure drop of the raw gas stream passing through the gas cooler is about 1–2 atms. The saturated steam that may be produced in the gas cooler may have a temperature in the range of about 350° to 700° F., such as about 450° to 600° F., and a pressure in the range of about 10 to 200 atms., such as about 30 to 100 atms. The superheated steam that may be produced in the gas cooler may have a temperature in the range of about 370° to 800° F., such as about 400° to 750° F., and a pressure in the range of about 10 to 200 atms., such as about 30 to 100 atms. The saturated and superheated steam may be simultaneously produced in the same vessel.

The gas cooler comprises a closed vertical cylindrical shaped steel pressure vessel 1 comprising outer shell 2 with a large upper coaxial central outlet 3 at the top, top cover plate 4, small coaxial top outlet 5 for the discharge of 0–100 wt. % of the saturated steam produced in the gas cooler, bottom end 6, bottom flange 7, and main boiler feed water (BFW) inlet 8. Gas inlet tube sheet 9 is located below inlet 8 and divides water inlet chamber 10 into low pressure space 11 with water outlet 12 and high pressure space 13 with water inlet 14. Boiler feedwater is introduced into chamber 10 by way of line 15, control valve 16, line 17, and inlet 8.

Hot raw gas inlet chamber 20 is provided with top flange 21 which is connected to bottom flange 7 of shell 2 by conventional means. Chamber 20 is lined with refractory 22 and is provided with side inlet 23 for the introduction of the hot raw gas stream. It is also equipped with clean-out bottom outlet 24 and flange cover 25. The hot raw gas stream entering chamber 20 through line 26 is split into a plurality of separate gas paths which leave chamber 20 through a plurality of outlets 27. The gas paths then run independently from each other through the evaporator and superheater sections of the gas cooler. A minimum effective gas velocity may be maintained in each gas path, even in case of part load operation, by locating an external shut-off valve at the cold end of each gas path.

A vertical cylindrically shaped elongated water-tight central chamber 28 is supported within vessel 1. The central axes of chamber 28 and vessel 1 are coaxial. Central chamber 28 is closed at the bottom end 29 and open at the upper end 30. Chamber 28 is supported, positioned and secured by structure 31 located above the bottom of vessel 1. Other side brackets (not shown) may also be used. Water inlet chamber 10 is located below bottom end 29 and is in communication with annular passage 33. Central coaxial chamber 28 defines with the inside walls of vessel 1 along its length annular elongated passage 33 that communicates near the top of the vessel with connecting passage 34. Water chamber 10 including spaces 11 and 13, and at least a portion of annular space 33 are filled with boiler feed water. Connecting passage 34 communicates with the upper end 30 of central chamber 28 and the upper central outlets 3 and 5. Central chamber 28 is provided near its bottom with at least one outlet 35 that passes through outer shell 2 with a gas-tight seal, for the discharge of superheated steam. For ease of assembly and maintenance, in a preferred embodiment the diameter of central chamber 28 is less than that of upper central outlet 3. Also, in a preferred embodiment, the upper end of central chamber 28 develops into a frusto-conical portion 36 to provide run-off of water that may accumulate on cylindrical shaped demister 37 from the saturated steam that is produced in annular passage 33. For convenience in servicing, demister 37 may be a cylindrical shaped screen that is passed through top outlet 5 and is supported by plate 4. Other suitable demisters may be used.

A plurality of vertical bundles of helical tubes with at least one helical tube in each bundle, are evenly spaced around annular passage 33, and may be supported at the bottom by beam structure 31. Thus, there may be from 2–20 bundles of helical tubes equally spaced in annular passage 33. Each bundle of tubes may have from 1–7 concentric rings, and each ring may have from 1–20 helical tubes. For example, the present vessel is provided with six helical bundles of tubes equally spaced in annular passage 33. Each bundle of tubes has 1 concentric ring containing 2 helical tubes. Two helical bundles of tubes 38 and 39 are shown in cross section in the drawing. Not shown in the drawing are four helical bundles of tubes, e.g., two bundles of helical tubes in each of the rear and front sections of the vessel. Thus, as shown in the drawing, helical bundle 38 comprises two helical tubes 40 and 41, and helical bundle 39 comprises two helical tubes 42 and 43. Further, gas inlet portions 44 and 45 are depicted for a helical bundle of tubes 46 (not otherwise shown) and gas inlet portions 47 and 48 are depicted for a helical bundle of tubes 49 (not otherwise shown). Helical bundles of tubes 46 and 49 are positioned in the rear section of the vessel. The two helical bundles of tubes in the front portion of the vessel are not shown in the drawing.

Each bundle of tubes extends lengthwise in a portion of the annular passage leaving a free annular space 50 above the tube bundles. The water flowing up through annular passage 33 is vaporized by indirect heat exchange with the hot gas stream flowing up through the plurality of bundles of helical tubes. The saturated steam produced above water level 51 in annular passage 33 passes up through annular space 50 and connecting passage 34. By external steam control valves in downstream lines connected to vessel 1, the gas cooler may be operated so that only a separate stream of saturated steam, or only a separate stream of superheated steam, or alternatively separate streams of both saturated and superheated steam may be produced. Further, steam pressure in the vessel may be adjusted by means of the external steam control valves. The external valving includes steam control valve 100 in external saturated steam lines 101–102, and a steam control valve (not shown) in the external superheated steam lines (not shown) connected to outlet 35. Thus, saturated steam only may be produced in vessel 1 and leaves through outlet 5. Alternatively, all of the saturated steam may be made to pass down through connecting passage 30 and central chamber 28 where superheating takes place. Another mode of operation is to split the saturated steam, remove a first portion of saturated steam through outlet 5, superheat the remainder in central chamber 28, and remove the superheated steam through outlet 35. Thus from about 0–100%, such as about 25–75 wt. %, of the total amount of steam discharged from the vessel may be superheated steam and the remainder, if any, of the steam discharged is saturated steam.

To prevent thermal damage, each helical tube in each bundle of helical tubes in the annular passage has a water jacketed inlet section. The jacketed inlet section is located between tube sheet 9 and the downstream inlet end of the tube in the upper portion of hot raw gas inlet chamber 20. For example, the water jacket for tube 40 includes pipe 56 that is concentric with and surrounds pipe section 55 of tube 40, thereby providing annular passage 57. Pipes 56 and 55 pass through tube sheet 9 and bottom end 6 of vessel 1. The outside surface of pipe 56 is sealed to tube sheet 9 with a water-tight seal. Pipe 58 passes through bottom end 6 of the vessel, and its external surface makes a water-tight seal therewith. Pipe 58 is concentric with and surrounds pipes 56 and 55. Annular passage 59 is provided between pipes 58 and 56. The ends of pipes 58 and 55 are sealed with a water-tight seal. The end of pipe 56 is retracted so that there is communication between the ends of annular passages 59 and 57. Water from high pressure space 13 flows down through the annular passage 59. The direction of flow for the cooling water is then reversed, and the water flows up through the annular passage 57. The cooling water is then discharged into low pressure space 11. The gas inlet sections for all of the other helical tubes in each of the bundles of helical tubes in the annular passage are similarly cooled. Circulating water pump 80 located outside of vessel 1 is used to pump water from space 11 by way of outlet 12, lines 81–82, and through inlet 14 into high pressure space 13.

Heat exchange between the water surrounding each of the helical bundle of tubes in annular passage 33 and the hot gas flowing within the helical bundles of tubes may be improved by optionally installing a cylindrical core pipe 52. Pipe 52 extends lengthwise along the central axis of each helical bundle of tubes. Pipe 52 is open at each end and is supported upright, for example by beam 31. For water circulation, a plurality of holes 53 are provided in that portion of the walls of pipe 52 that extends from the point of lowest water level to near the top of the pipe.

A central bundle of helical tubes 60 through which hot gas flows extends vertically in central chamber 28 where the saturated steam from annular passage 33 is superheated. The central longitudinal axis of the central bundle of helical tubes is coaxial with vessel 1 and comprises at least one concentric ring of helical tubes with at least one helical tube in each ring. Thus, the central bundle of helical tubes may have 1–12 concentric rings, and each ring may contain from 1–40 helical tubes. Beam support 61, for example, supports the bottom of helical tube bundle 60. The inlet to each helical tube in the central bundle of helical tubes is serially connected to the outlet section from an individual helical tube is one of the annular bundles of helical tubes. Thermally efficient countercurrent heat exchange is obtained by passing saturated steam from annular passage 33 down over the outside surface of the central bundle of helical tubes while simultaneously passing the partially cooled gas stream up through the inside of the helical tubes in the central bundle of tubes.

In the drawing, outlet sections 62 and 63 of helical tubes 40 and 41 respectively leave from the top of annular bundle of helical tubes 38, pass through the wall of central chamber 28, and are connected respectively to inlet sections 64 and 65 at the bottom of the central bundle of helical tubes 60. In a similar manner, the outlet sections from the other ten helical tubes from the five other annular bundles of helical tubes are connected to the inlet sections of tubing at the bottom of the central bundle of helical tubes 60. For example, the outlet sections for the two tubes leaving the annular bundle of helical tubes 46 (not shown) are connected to inlet sections 66 and 67 at the bottom of the central bundle of helical tubes.

All of the cooled gas leaving from the top of the central bundle of helical tubes 60 may be removed from vessel 1 through individual outlet lines, such as 68–71 that penetrate shell 2. Alternatively, all of the cooled gas from all of the individual helical tubes may be collected in header 75 and be discharged through outlet 76. In the embodiment shown in the drawing, at least one gas outlet section of a helical tube passes through the walls of central chamber 28 and outer shell 2, making gas-tight seals therewith. The gas outlet sections for the remaining helical tubes pass into a gas outlet header located within the vessel and make gas-tight seals therewith. The header is in direct communication with an outlet conduit that passes through the walls of the central chamber and the vessel, with a gas-tight seal. For example, as shown in the drawing gas outlet lines 68–71 pass through the walls of central chamber 28 and outer shell 2 of vessel 1. The gas outlet sections for the remaining helical tubes discharge into header 75 located above the central bundle of helical tubes 60. The header outlet conduit 76 passes through the walls of central chamber 28 and shell 2. Where lines 68–71 and the header outlet pass through said walls and shell, sealing is provided to prevent leaks and to provide a gas-tight seal.

In another embodiment, upper central outlet 5 is covered with a flange plate (not shown) and is provided with a side outlet (not shown) through which saturated steam may be discharged, if any. The gas outlet sections for all of the tubes in the central bundle of helical tubes pass up through said upper central outlet flanged cover plate, and make gas-tight seals therewith. Alternatively, in this embodiment, the gas outlet sections for all of the helical tubes in the central bundle pass into a header supported in the upper section of the vessel and make gas-tight seals therewith. The header is in direct communication with an outlet conduit that passes through said central outlet flange plate, and makes a gas-tight seal therewith.

Advantageously, by the subject design, when required for turn-down, one or more of the individual helical coils 40–43, or all of the helical coils that discharge into header 75 may be shut down by external valving without completely shutting down the gas cooler. For example, the gas streams flowing in helical coils 40–43 may be turned off or on independently from each other by opening or closing gas flow control valve 85 in lines 86–87, gas flow control valve 88 in lines 89–90, gas flow control valve 88 in lines 89–90, gas flow control valve 91 in lines 92–93, and gas flow control valve 94 in lines 95–96, respectively. Similarly the gas streams flowing in the coils that discharge into header 75 may be turned off or on by opening or closing gas valve 97 in lines 98–99. When the amount and temperature of the hot raw gas stream that is introduced into the gas cooler are fixed, the temperature of the saturated steam, superheated steam, and cooled raw gas leaving vessel 1 may be controlled by varying the water level 51 in annular passage 33, and by controlling the split between the saturated and superheated steam by means of the external saturated and superheated steam control valves.

The liquid level in vessel 1 may be measured by a conventional indicator 110, for example comprising level sensing and transmitter LT and a level indicator and controller LIC. Thus, a conventional differential pressure level detector may be used to measure the liquid level. Responsive to a signal from LT, the introduction of BFW from line 15 into inlet 8 may be controlled by LIC providing a pneumatic or electronic signal to open or close flow control valve 16 in the BFW line. By this means, the water in annular passage 33 is controlled at a desired level so that about 75 to 100%, and preferably 100% of the surface area of each annular bundle of helical tubes is submerged in the boiler feed water.

In order to prevent the central bundle of helical tubes 60 in the superheat section of the gas cooler from overheating, the raw gas stream leaving the annular bundles of helical tubes in the evaporator section must have been cooled down to a temperature in the range of about 600° to 1800° F., such as about 800° to 1200° F. Further, the raw gas stream leaving the gas cooler must be at a temperature above its dew point in order to prevent excessive fouling and possible plugging. The temperature of the raw gas going into the superheat section can be controlled by varying the water level in annular passage 33. For example, lowering the water level will reduce the area of high heat transfer from the hot gas to the water and thereby reduce the amount of gas cooling, and vice versa. The temperature of the raw gas exciting from the superheat section is a function of the amount and temperature of the saturated steam being superheated. Advantageously, by the subject design the gas cooler may be easily turned up or down with load by independently opening or closing off one or more of the helical tubes. As described previously, this may be done safely by operating the external gas flow control valves in the individual gas lines or in the gas header discharge lines. The gas flow control valves are located downstream from the gas cooler at the cold end of each gas path, as previously described. Further, along with the efficient cooling of the hot gas stream containing entrained matter without fouling or clogging the tubes, saturated steam, superheated steam, or both may be simultaneously produced.

Although modifications and variations of the invention may be made without departing from the spirit and scope thereof, only such limitations should be imposed as are indicated in the appended claims.

We claim:

1. A gas cooler for cooling a hot raw gas stream comprising:

(1) a closed vertical cylindrically shaped pressure vessel with an upper central outlet for the passage of saturated steam;

(2) a refractory lined hot gas inlet chamber with a gas inlet, said gas inlet chamber being attached to the bottom end of said pressure vessel;

(3) a vertical coaxial cylindrically shaped elongated central chamber which is closed at the bottom and open at the top, means for supporting said central chamber above the bottom of said vessel thereby providing a water chamber between the bottoms of the pressure vessel and the central chamber, an inlet in the side wall of said water chamber for introducing water in liquid phase into the pressure vessel, said central chamber defining with said vessel along its length an annular elongated passage that communicates at the bottom with said water chamber and near the top of the vessel with a connecting passage that communicates with the top of said central chamber and said upper central outlet; said central chamber being provided near its bottom with outlet means that passes through the wall of the vessel with a gas-tight seal and through which superheated steam may be discharged;

(4) a plurality of vertical bundles of helical tubes with at least one helical tube in each bundle, said bundles of helical tubes being supported in said annular passage, each of said bundles of tubes extending lengthwise in a portion of said annular passage leaving a free annular space above said bundle of tubes for the passage of saturated steam, and wherein each of said helical tubes has a gas outlet section at the upper end and a gas inlet section at the bottom end and each gas inlet section extends through the bottom end of said vessel and into said hot gas inlet chamber; means for cooling the gas inlet section of each helical tube in each bundle of helical tubes in the annular passage; and (5) a central bundle of helical tubes extending vertically in said central chamber, said central bundle of tubes comprising at least one concentric ring of helical tubes with at least one helical tube in each ring; wherein the downstream end of each helical tube in the central bundle is provided with a gas outlet means through which cooled raw gas may be passed, and the upstream end is provided with a gas inlet which is in communication with the gas outlet end of a helical tube from a bundle of helical tubes in the annular passage, and the gas inlet end of each helical tube in the central bundle of helical tubes is at the lower end of the central bundle of helical tubes; and means for controlling the level of the water in the vessel.

2. The gas cooler of claim 1 provided with a liquid level indicating means.

3. A gas cooler of claim 1 wherein demister means are provided in the connecting passage in (3).

4. The gas cooler of claim 1 wherein each of the vertical bundles of helical tubes in (4) surrounds an elongated cylindrical pipe along its length.

5. The gas cooler of claim 4 wherein the walls of each said elongated cylindrical pipe are provided with a plurality of holes extending from the lowest water level to the upper end of the pipe.

6. The gas cooler of claim 1 provided with external gas flow control means connected in the lines downstream from the gas outlet means of said central bundle of helical tubes.

7. The gas cooler of claim 1 provided with separate external steam control means connected in the lines leading from said upper central outlet and from the bottom outlet means of said central chamber.

8. The gas cooler of claim 7 wherein said steam control means comprises a steam valve.

9. The gas cooler of claim 1 wherein the gas outlet sections for all of the tubes in the central bundle of helical tubes in (5) pass through the walls of the central chamber and then through the side walls of the vessel, and make gas-tight seals therewith.

10. The gas cooler of claim 1 wherein the gas outlet sections for all of the tubes in the central bundle of helical tubes in (5) pass into a gas outlet header within the vessel and make gas-tight seals therewith, and said header is in direct communication with an outlet nozzle that passes through the vessel wall, with a gas-tight seal.

11. The gas cooler of claim 1 wherein the gas outlet section of at least one tube in the central bundle of helical tubes in (5) passes through the walls of the central chamber and the vessel and makes gas-tight seals therewith, and the gas outlet sections for the remaining tubes in the central bundle of helical tubes pass into a gas outlet header within the vessel and make gas-tight seals therewith, and said header is in direct communication with an outlet conduit that passes through the vessel wall and makes a gas-tight seal therewith.

12. The gas cooler of claim 11 provided with external gas flow control means located downstream from said heat exchanger and being separately connected to the gas outlet section of each tube in the central bundle of helical tubes that passes through the vessel wall, and to the outlet conduit for the gas outlet header.

13. The gas cooler of claim 1 wherein the upper central outlet in (1) is covered with a flange plate and is provided with a side outlet for passage of said saturated steam, and wherein the gas outlet sections for all of the tubes in the central bundle of helical tubes in (5) pass through said upper central outlet flange plate, and make gas-tight seals therewith.

14. The gas cooler of claim 13 wherein the gas outlet sections for all of the tubes in the central bundle of helical tubes pass into a header within the vessel and make gas-tight seals therewith, and said header is in direct communication with an outlet conduit that passes through said central outlet flange plate and makes a gas-tight seal therewith.

15. The gas cooler of claim 1 provided with 2–24 bundles of helical tubes in the annular passage in (4), wherein each bundle of tubes has from 1–12 concentric rings, and each ring has from 1–20 helical tubes.

16. The gas cooler of claim 1 provided with 6 bundles of helical tubes in the annular passage in (4), each bundle of tubes has one concentric ring, and each ring has two helical tubes.

17. The gas cooler of claim 1 wherein the central bundle of helical tubes in (5) has 1–12 concentric rings, and each ring has from 1–40 helical tubes.

18. The gas cooler of claim 1 wherein the central bundle of helical tubes in (5) has one concentric ring, and each ring has twelve helical tubes.

19. The gas cooler of claim 1 wherein the central bundle of helical tubes in (5) is supported to provide a space between the bottom of said bundle of tubes and the bottom of said central chamber, and said outlet means in (3) to remove superheated steam is in direct communication with said space.

20. The gas cooler of claim 1 wherein the water chamber in (1) is separated into upper and lower compartments by a tube sheet, and the gas inlet sections for all of the helical tubes in the bundles of helical tubes in the annular passage pass through said tube sheet as well as through the bottom of the vessel and make liquid-tight seals therewith.

21. The gas cooler of claim 20 wherein the gas inlet section for each helical tube in each bundle of helical tubes in the annular passage is provided with a water jacket.

22. The gas cooler of claim 1 wherein a boiler feed water line is connected to the inlet of said water chamber in (3), saturated steam is removed from the upper central outlet in the vessel, and superheated steam is removed from the central chamber outlet means in (3).

23. In a process for producing steam by the indirect heat exchange between $H_2O$ and the hot raw gas stream produced in a partial oxidation process, the improvement which comprises:

(1) continuously introducing boiler feed water into a vertical annular passage located between the inside wall of a closed vertical pressure vessel and the outside wall of a coaxial vertical cylindrically shaped elongated central chamber which is open at the top and closed at the bottom, and contacting said boiler feed water with the outside surfaces of a plurality of vertical bundles of helical tubes spaced in said annular passage, with each tube bundle comprising at least one helical coil;

(2) continuously passing a hot raw gas stream from the partial oxidation of a gaseous or liquid hydrocarbonaceous fuel or a solid carbonaceous fuel with a free-oxygen containing gas in the presence of a temperature moderator through said helical tubes in indirect heat exchange with said boiler feed water so as to boil said water and to produce saturated steam; and (3) discharging all of the saturated steam from (2) through an upper outlet at or near the top of said pressure vessel; or alternatively discharging at least a portion of the saturated steam from (2) down through said central chamber and over a central bundle of helical tubes contained therein and comprising a plurality of helical tubes whose inlets are connected to the outlets of the helical tubes in said annular passage, and discharging the remainder of said saturated steam, if any, from said upper outlet in the vessel; simultaneously passing the partially cooled raw gas stream leaving the helical tubes in the annular passage in (2) through the helical tubes in said central helical bundle of tubes in indirect heat exchange with said saturated steam when present, thereby cooling said raw gas stream and producing superheated steam when heat exchange between said raw gas stream and said saturated steam has taken place; and removing from said pressure vessel at least one stream of cooled raw gas, and a separate stream of saturated or superheated steam, or alternatively separate streams of saturated and superheated steam.

24. The process of claim 23 where in (3) from about 0 to 100 wt. % of the saturated steam from (2) is superheated.

25. The process of claim 23 where about 25–75 wt. % of the total amount of steam discharged from said vessel is superheated steam and the remainder of the steam discharged from the vessel is saturated steam.

26. The process of claim 23 where the cooled raw gas stream in (3) is removed from said pressure vessel as a plurality of separate streams.

27. The process of claim 23 where in (3) said saturated steam passes in countercurrent heat exchange with the partially cooled raw gas stream from (2).

* * * * *